US007603832B2

(12) United States Patent
Kudoh et al.

(10) Patent No.: US 7,603,832 B2
(45) Date of Patent: Oct. 20, 2009

(54) PACKING APPARATUS, PACKING BAG FORMING METHOD, AND PACKING METHOD

(75) Inventors: Tomiya Kudoh, Atsugi (JP); Shohji Ohtsu, Sagamihara (JP); Hajime Kawamata, Atsugi (JP); Kazuhiro Kanno, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 263 days.

(21) Appl. No.: 11/614,727

(22) Filed: Dec. 21, 2006

(65) Prior Publication Data

US 2007/0157571 A1 Jul. 12, 2007

(30) Foreign Application Priority Data

Dec. 21, 2005 (JP) ..... 2005-367674

(51) Int. Cl.
*B65B 43/04* (2006.01)
*B65B 9/12* (2006.01)

(52) U.S. Cl. ..... 53/455; 53/562; 53/548; 493/269; 493/357

(58) Field of Classification Search ..... 53/453, 53/455, 450, 562, 563, 559, 548; 493/967, 493/269, 287, 308, 357
See application file for complete search history.

(56) References Cited

U.S. PATENT DOCUMENTS 1,874,728 A * 8/1932 Willis ..... 493/357
1,878,437 A * 9/1932 Campbell ..... 493/357
3,246,444 A * 4/1966 Paisley ..... 53/412
3,462,913 A * 8/1969 Bodolay et al. ..... 53/562
3,534,520 A * 10/1970 Moran ..... 53/416
3,553,934 A * 1/1971 Johnson et al. ..... 53/562
3,790,652 A * 2/1974 Colijn et al. ..... 264/146
3,843,113 A * 10/1974 Schaffer ..... 493/357
4,055,109 A * 10/1977 Kan ..... 493/196
4,201,031 A * 5/1980 Wiles ..... 53/455
4,512,136 A * 4/1985 Christine ..... 53/410
4,617,785 A * 10/1986 Chikatani et al. ..... 53/562
4,761,937 A * 8/1988 Francioni ..... 53/550
4,847,126 A * 7/1989 Yamashiro et al. ..... 428/35.2
5,080,747 A * 1/1992 Veix ..... 156/352

(Continued)

FOREIGN PATENT DOCUMENTS

JP 58-211440 12/1983

(Continued)

*Primary Examiner*—Paul R Durand
(74) *Attorney, Agent, or Firm*—Oblon, Spivak, McClelland, Maier & Neustadt, L.L.P.

(57) ABSTRACT

A packing apparatus of the present invention includes an original roll having a packing material sheet that contains a middle portion in a width direction, and a triangular plate having a triangular plane, and oblique sides connecting the base and the vertex, the material sheet is folded in two at the width-direction middle portion by the vertex with a tension applied to the material sheet, to form a bending portion, an overlapped portion containing sides in a width direction, and a triangular open space. Furthermore, the packing apparatus includes a pair of drawing rolls for drawing out the material sheet and, and a fusing and cutting device for fusing and cutting the overlapped portion to consecutively form a packing bag having the bending portion as a bottom and the open space as an insertion aperture for a packed member.

11 Claims, 7 Drawing Sheets

U.S. PATENT DOCUMENTS

| | | | | |
|---|---|---|---|---|
| 5,181,365 | A * | 1/1993 | Garvey et al. | 53/455 |
| 5,338,282 | A * | 8/1994 | Ferrone | 493/342 |
| 5,810,706 | A * | 9/1998 | McDonald et al. | 493/212 |
| 5,830,118 | A * | 11/1998 | Nicholson | 493/196 |
| 6,050,061 | A * | 4/2000 | Todd et al. | 53/455 |
| 6,106,452 | A * | 8/2000 | Baumuller | 493/464 |
| 6,257,142 | B1 * | 7/2001 | Baba | 101/480 |
| 6,272,815 | B1 * | 8/2001 | Todd et al. | 53/562 |
| 6,534,148 | B1 * | 3/2003 | Baumuller | 428/126 |
| 6,732,491 | B2 * | 5/2004 | Buchman | 53/412 |
| 6,780,146 | B2 * | 8/2004 | Thomas et al. | 493/213 |
| 2001/0008064 | A1 * | 7/2001 | Todd et al. | 53/455 |
| 2005/0086911 | A1 * | 4/2005 | Dutt et al. | 53/412 |
| 2006/0070351 | A1 * | 4/2006 | Hudetz et al. | 53/410 |

FOREIGN PATENT DOCUMENTS

| | | |
|---|---|---|
| JP | 10-058560 | 3/1998 |
| JP | 10-147372 | 6/1998 |
| JP | 2002-160310 | 6/2002 |

* cited by examiner

PACKING APPARATUS, PACKING BAG FORMING METHOD, AND PACKING METHOD

PRIORITY CLAIM

Priority is claimed on Japanese Patent Application No. 2005-367674, filed with the Japanese Patent Office on Dec. 21, 2005, the content of which is incorporated herein by reference.

BACKGROUND OF THE INVENTION

1. Field of the Invention

The present invention relates to a packing apparatus, a packing bag forming method and a packing method for forming a bag having an insertion aperture at one end using a packing plastic bubble material sheet, and for packing a packed material by inserting the packed material into a bag through the insertion aperture.

2. Description of the Related Art

Conventionally, there is known a packing bag manufacturing apparatus for forming a packing bag. See, for example, Japanese Patent Publication Hei 10-58560. The packing bag manufacturing apparatus intermittently pulls out a packing plastic bubble material sheet from an original roll having the sheet. Using an end portion of a folding-in-two and overlapping triangular plate, the manufacturing apparatus overlaps the sheet at a width-direction middle point of the sheet to form a packing bag by piling up the sheets.

However, when a conventional bag manufacturing apparatus has a short distance between an original roll and a triangular plate, a wrinkle tends to be produced at a bent portion. Because of this, a process distance from an original roll to a packing bag completion process need be designed to be long, which raises a disadvantage that a bag manufacturing apparatus becomes large-sized, since it requires a plurality of support auxiliary rolls midway in a conveyance direction so that a packing plastic bubble material sheet, which is folded and overlapped after being pulled out from an original roll, does not shift in a width direction during conveyance.

Moreover, a conventional bag manufacturing apparatus can consecutively produce a packing bag. However, when a packed member is going to be packed in a packing bag later, there is a disadvantage that work efficiency of packing will be lower, and that inventory management of packing bags is required.

For the foregoing reasons, there is a need for a packing apparatus, packing bag forming method, and packing method that can prevent wrinkles from being produced at a bending portion of a packing plastic bubble material sheet that is folded and piled up after being pulled out from an original roll, and that can manufacture a bag and simultaneously pack a packed member. Furthermore, there is a need for a packing apparatus that can be downsized.

SUMMARY OF THE INVENTION

The present invention is directed to a packing apparatus, packing bag forming method, and packing method that satisfies this need. The first aspect of the invention relates to a packing apparatus. The packing apparatus comprises a holding roll for holding an original roll having a packing plastic bubble material sheet that contains a middle portion in a width direction; a triangular plate having a triangular plane, a base, a vertex, and oblique sides connecting the base and the vertex, the material sheet pulled out from the original roll, and folded in two at the width-direction middle portion by the vertex while being traveled along the triangular plane from the base to the vertex with a tension applied to the material sheet along the oblique sides, to form a bending portion on a side of the vertex, an overlapped portion containing sides in a width direction, and a triangular open space on a side of the base, a pair of drawing rolls for drawing out the width-direction middle portion of the material sheet and the overlapped width-direction sides while holding the bending portion; and a fusing and cutting device positioned away from the drawing rolls for fusing and cutting the overlapped portion in a width direction to consecutively form a packing bag having the bending portion as a bottom and the open space as an insertion aperture for a packed member, wherein drawing rolls are positioned with respect to the triangular plate so that the tension is produced in a direction to curb the bending portion that is supposed to be drawn out.

The second aspect of the invention relates to another packing apparatus. The packing apparatus comprises a holding roll for holding a original roll having a packing plastic bubble material sheet that contains a middle portion in a width direction; a triangular plate having a triangular plane, a base, a vertex, and oblique sides connecting the base and the vertex, the material sheet pulled out from the original roll, and folded in two at the width-direction middle portion by the vertex while being traveled along the triangular plane from the base to the vertex with a tension applied along the oblique sides, to form a bending portion on a side of the vertex, an overlapped portion containing sides in a width direction, and a triangular open space on a side of the base, a pair of drawing rolls for drawing out the width-direction middle portion of the material sheet and the overlapped width-direction sides while holding the bending portion; and a fusing and cutting device positioned away from the drawing rolls for fusing and cutting the overlapped portion in a width direction to consecutively form a packing bag having the bending portion as a bottom and the open space as an insertion aperture for a packed member, wherein the triangular plate is positioned having a downward inclination angle with respect to a horizontal plane from the base toward the vertex, and wherein the drawing rolls are positioned having an inclination angle with respect to the horizontal plane so that the tension is produced in a direction to curb the bending portion that is supposed to be drawn out.

Advantageously, the downward inclination angle for the rolls is smaller than the inclination angle for the triangular plate.

Advantageously, the drawing rolls are synchronously rotated with respect to each other.

Advantageously, the fusing and cutting device includes a pair of supporting plates for supporting the material sheet from an overlapping direction and a heating wire for fusing and cutting the overlapped portion, and wherein one of the supporting plates, positioned vertically, contains supporting portions positioned vertically with the heating wire placed therebetween for supporting the overlapped portion in cooperation with the other plate.

Advantageously, the packing apparatus further comprises a receiver movable upward and downward for receiving for receiving a packed member inserted into the packing bag at the insertion aperture.

The third aspect of the invention relates to a method of forming a packing bag. The method comprises traveling a packing plastic bubble material sheet pulled out from an original roll along a triangular plane of a triangular plate while applying a tension to the material sheet along oblique sides connecting a base and a vertex of the triangular plate;

sliding the material sheet from the base to the vertex while applying a reaction for curbing a drawn quantity of a middle portion of the material sheet in a width direction to both sides of the material sheet in a width direction that is contained in an overlapped portion; forming a bending portion on a side of the vertex and a triangular open aperture on a side of the base by folding the material sheet using the vertex; drawing out the width-direction middle portion and the overlapped width-direction sides while holding the bending portion through a pair of drawing rolls; and fusing and cutting the overlapped portion in a width direction using a fusing and cutting device to consecutively form a packing bag having the bending portion as a bottom and the open space as an insertion aperture for a packed member.

The fourth aspect of the invention relates to a packing method. The packing method comprises traveling a packing plastic bubble material sheet pulled out from an original roll along a triangular plane of a triangular plate while applying a tension to the material sheet along oblique sides connecting a base and a vertex of the triangular plate; sliding the material sheet from the base to the vertex while applying a reaction for curbing a drawn quantity of a middle portion of the material sheet in a width direction to both sides of the material sheet in a width direction that is contained in an overlapped portion having an end; forming a bending portion on a side of the vertex and a triangular open aperture on a side of the base by folding the material sheet using the vertex; drawing out the width-direction middle portion and the overlapped width-direction sides while holding the bending portion through a pair of drawing rolls; fusing and cutting off the end of the overlapped portion in a width direction, using a welding and cutting device; automatically pulling out a predetermined amount of the material sheet using the drawing rolls to form an incomplete packing bag having the bending portion as a bottom and the open space as an insertion aperture for a packed member; inserting into the incomplete packing bag the packed member through the insertion aperture thereof; fusing and cutting, in a width direction, the incomplete packing bag into which the packed member is inserted, using the welding and cutting device to form a packing bag with the packed member inserted therein; and consecutively iterating a series of steps from the step of forming an incomplete packing bag to the step of forming a packing bag.

DETAILED DESCRIPTION OF THE INVENTION

Figure 1:
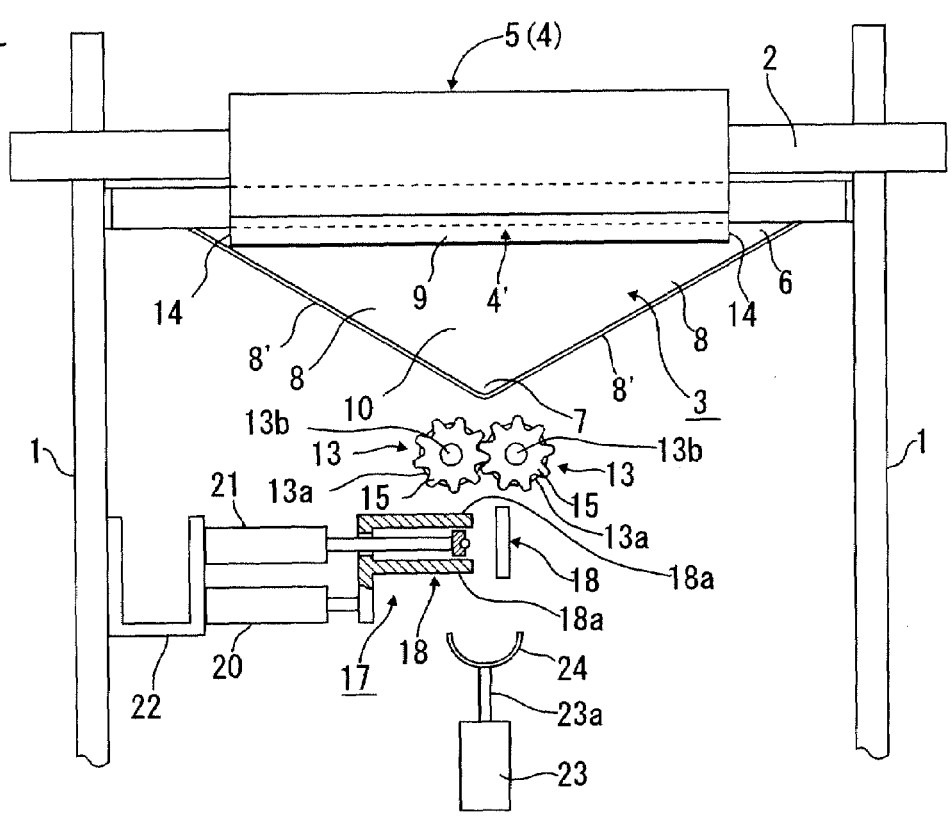
FIG. 1 is a front view illustrating a packing apparatus in accordance with an embodiment of the present invention, which shows a state before a roll of plastic bubble material sheet is drawn from an original roll.

An embodiment of a packing apparatus, a packing bag forming method, and a packing method in accordance with the present invention will be explained, referring to the figures.

FIGS. 1 to 5 show a front view of a packing apparatus in accordance with the present invention. In the figures, reference numerals 1 and 1 represent a frame, respectively, that is provided vertically. Mounted at the frames 1, 1 are a horizontal holding roll 2 and a triangular plate 3. Drawably provided with the horizontal holding roll 2 is an original roll 5 having a roll of plastic bubble material sheet 4 (hereinbelow simply called sheet (so called air cap)) for a packing use. The horizontal position of the sheet 4 can be properly adjusted by a spacer member (not shown).

The triangular plate 3, as shown in FIG. 1, includes a base 6, a vertex 7, and oblique side portions 8 and 8. The vertex 7, formed to have a smooth curvature, plays a role of bending the sheet 4 drawn from the original roll 5 into two at a width-direction middle portion 9. The sheet 4 is drawn in a direction reverse to a direction for winding the original roll 5. The oblique side portions 8 and 8 have the power to move the drawn sheet 4 along a triangular plane 10 and apply a tension along the oblique sides 8' and 8' that connect the base 6 and the vertex 7.

The triangular board 3, as shown in FIGS. 1 to 6, is placed downward with respect to the horizon from the base 6 to the vertex 7. While drawing out and sliding the sheet 4 along the triangular plane 10 from the base 6 to the vertex 7, the triangular board 3 plays a role in forming a bending portion 11 (see FIGS. 2 to 6) on the side of the vertex by bending the width-direction middle portion 9 of the sheet 4, using the vertex 7, and in forming a triangular open space 12 (refer to FIG. 6) on the base side.

A pair of drawing rolls 13 and 13 (not shown) is provided with the frame below the triangular plate 3. It is desirable that the distance from the pair of drawing rolls 13 and 13 to the vertex 7 be approximately identical to the diameter of the drawing rolls 13 and 13.

Figure 5:
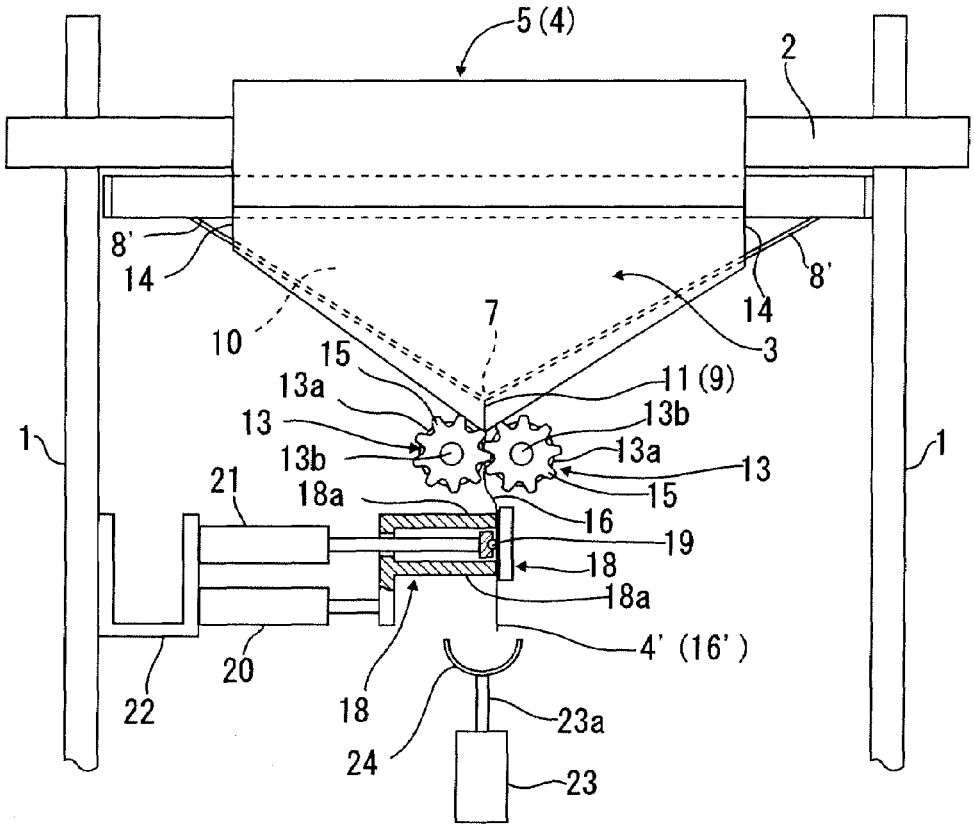
FIG. 5 is a view for showing how the overlapped portion of FIG. 4 is fused by a heating wire of FIG. 1.

The pair of drawing rolls 13 and 13, as shown in FIG. 5, as shown in FIG. 5, is provided with an inclined angle with respect to the horizontal plane. The inclined angle is designed to be smaller than that of the triangular plate 3 with respect to the horizontal plane.

The pair of drawing rolls 13 and 13 plays a role in drawing out the width-direction middle portion 9 and overlapped width-direction sides 14 and 14 of the sheet 4, holding the bending portion 11.

The reason why the pair of drawing rolls 13 and 13 is set obliquely with respect to the triangle plate 3 is as follows.

When the pair of drawing rolls 13 and 13 is set in parallel with respect to the triangle plate 3, it is probable that the sheet 4 is caught on the vertex 7*b* to be torn away at the time of drawing the sheet 4 by the pair of drawing roll 13 and 13.

Figure 6:
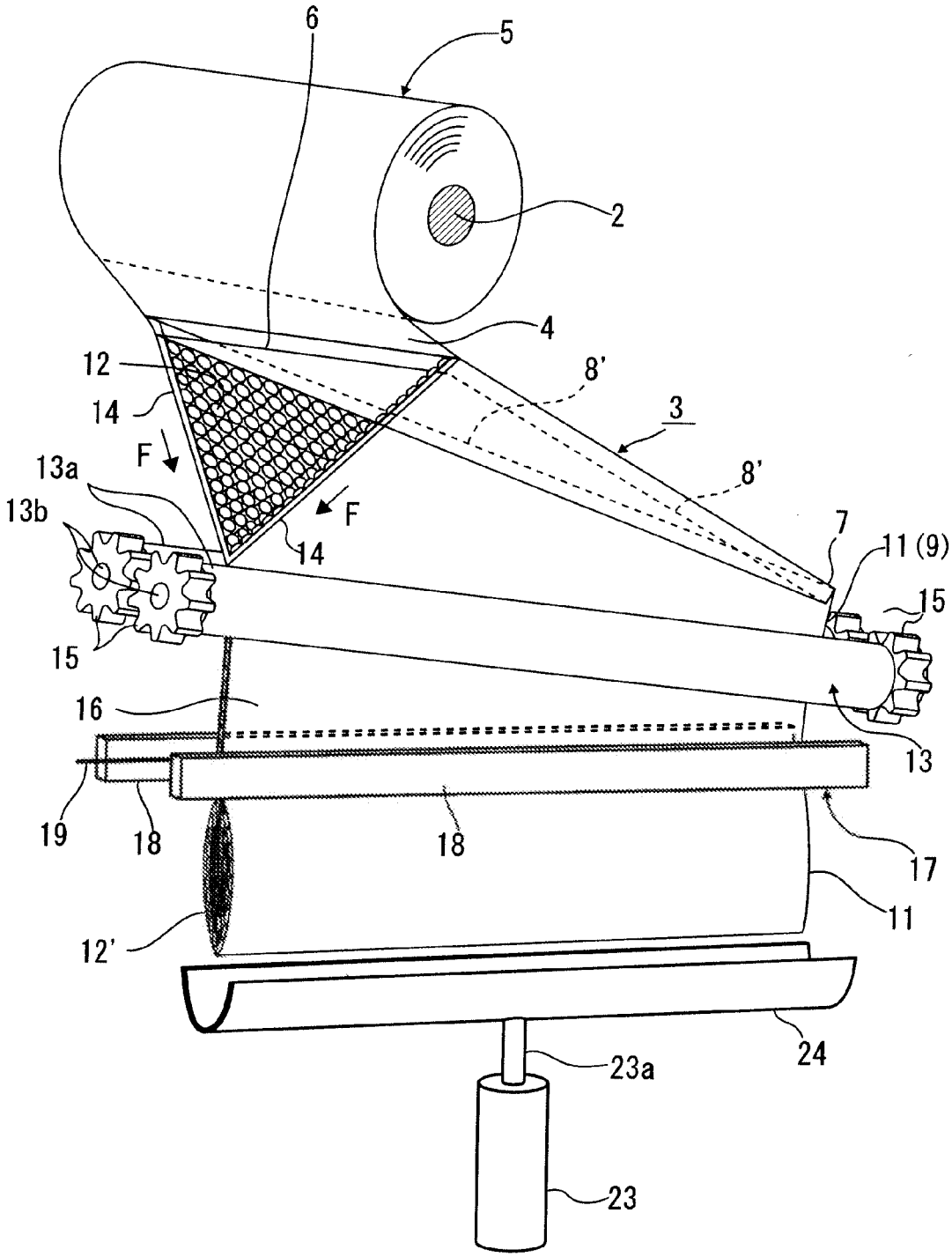
FIG. 6 is a perspective view of the packing apparatus shown in FIGS. 1 to 5.

The pair of drawing rolls 13 and 13, as shown in FIG. 6, has gears 15 and 15 provided with both ends thereof. The gears 15 and 15 can engage with each other to be rotated synchronously.

Figure 2:
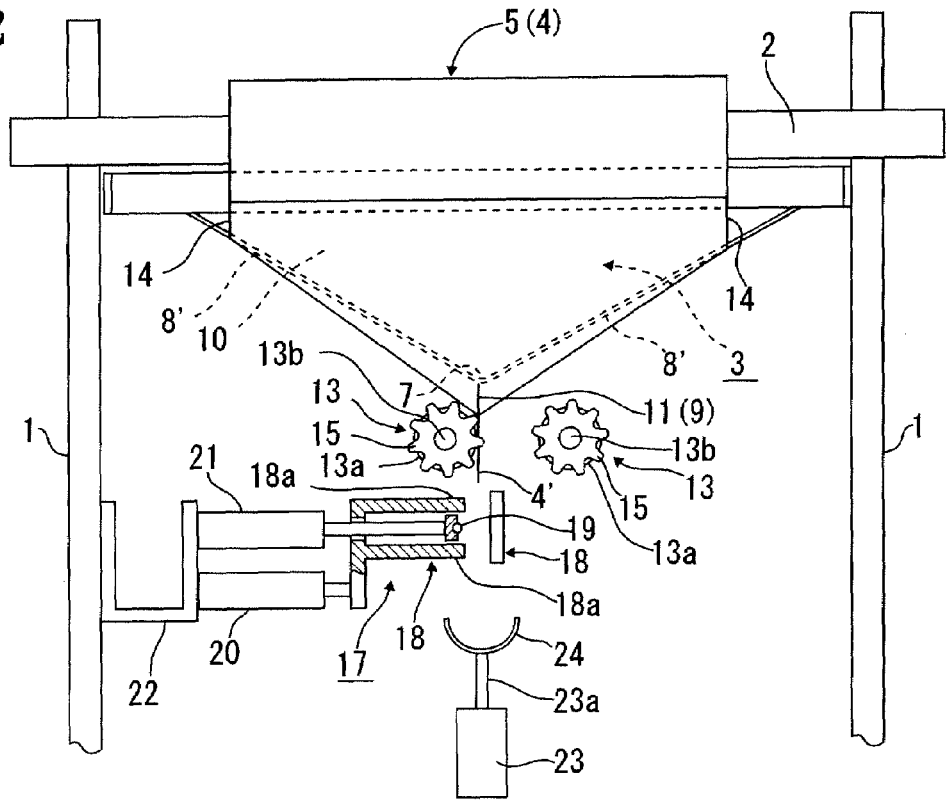
FIG. 2 is a view for illustrating how apart a pair of drawing rolls shown in FIG. 1 is separated.

The pair of drawing rolls 13 and 13 can be manually moved toward and away from each other. FIG. 2 shows a case in which the pair of drawing rolls 13 and 13 is moved away from each other.

A fusing and cutting device 17 is provided, as shown in FIGS. 1-6, under the pair of drawing rolls 13 and 13 on the front side of and in the direction of the sheet 4 that is pulled out. The fusing and cutting device 17 is used for fusing and cutting a overlapped portion 16 of the sheet 4 in the direction of the width thereof.

The fusing and cutting device 17 includes a heating wire and a pair of supporting plates 18 and 18 for supporting the sheet 4 in the superposition direction. One of the supporting plates 18 and 18 lies vertically sandwiching the heating wire 19, as shown in FIGS. 1-5, and includes supporting portions 18*a* and 18*a* for supporting the overlapped portion 16 cooperating with the other of the supporting plates 18 and 18. The pair of supporting portions 18*a* and 18*a* is driven by a cylinder device 20 to be able to move close to or away from the other supporting plate 18.

The heating wire 19 is driven by a cylinder device 21 so as to be able to come near to or go away from the other supporting plate 18. The cylinder devices 20 and 21 are fixed at one of the frames 1 through a bracket 22. The other supporting plate 18 is fastened to the other frame 1 through another bracket (not shown).

A cylinder device 23 is fixed at the bottom of the frames 1 and 1. A receiver 24 is provided at the top of a cylinder rod 23*a* of the cylinder device 23. The receiver 24, having a semi-cylindrical form for receiving a packed member to be explained later, can move upward and downward.

The fusing and cutting device 17 fuses and cuts the overlapped portion 16 of the sheet 4, and plays a role in forming packing bags sequentially in which the bending portion 11 is regarded as a bottom 11' (refer to FIG. 6) and the open space 12 as an insertion aperture 12' of the packed member, respectively.

Working procedure of a packing method using a packing apparatus in accordance with the present invention will be described below.

As shown in FIG. 2, one of the pair of rolls 13 and 13 is set to be separated from the other roll 13.

With an end portion 4' of the sheet 4 held by both hands, the sheet 4 is pulled out from the original roll 5. While the end portion 4' is moved along the triangular plane 10 of the triangular plates 3 and a reaction is applied to the sheet 4 along the oblique sides 8' and 8', a reaction F (refer to FIG. 6) for restraining a drawn quantity for the width-direction middle portion 9 of the sheet 4 is applied to the width-direction sides 14 and 14 of the sheet 4. With the conditions kept, being slid from the bottom 6 to the vertex 7, the sheet 4 is bent by using the vertex 7, which forms a bending portion 11 on the side of the vertex 7 and, at the same time, a triangular open space 12 (refer to FIG. 6) on the side of the bottom 6.

Figure 3:
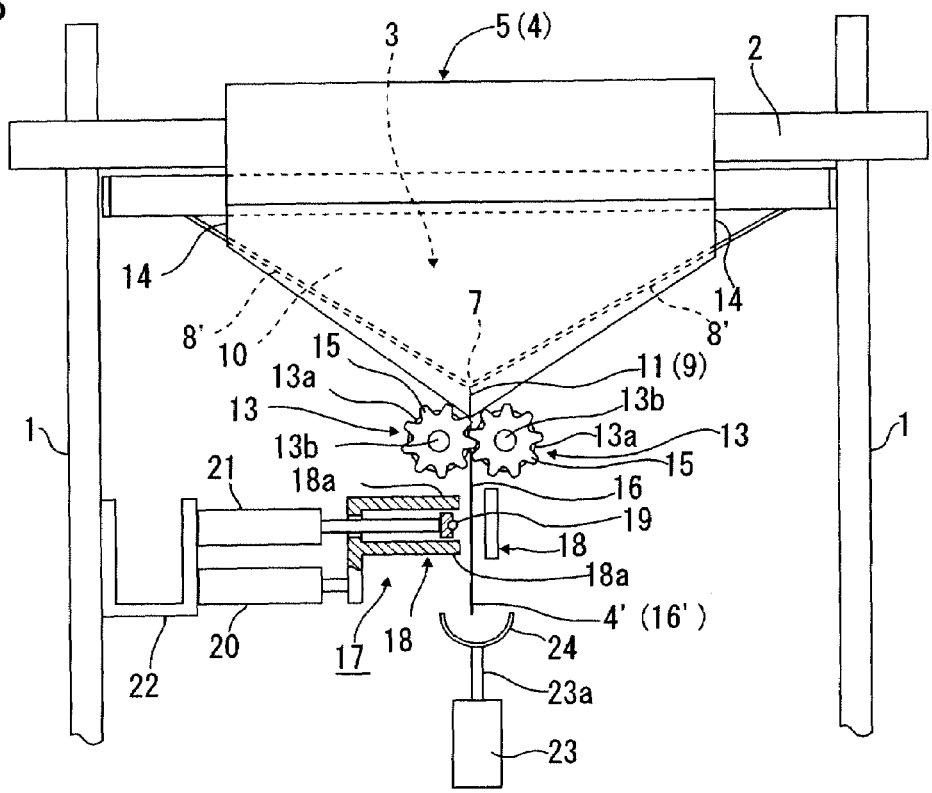
FIG. 3 is a view for showing how a overlapped portion is held by a pair of drawing rolls after the sheet of FIG. 1 is drawn.

The sheet 4, including the bending portion 11 and the width-direction side 14, is held at appropriate positions, by bringing the pair of drawing rolls 13 and 13 closer to each other, as shown in FIG. 3. In FIGS. 1 to 5, a reference numeral 13*a* represents a supporting roll; a reference numeral 13*b* a roll axis.

Since a pair of drawing rolls 13 and 13 through a gear 15 driven by a drive device (not shown) holds the sheet 4 at appropriate positions from the width-direction middle portion 9 to the overlapped width-direction sides 14, the sheet 4 is automatically pulled out as shown in FIG. 3.

Figure 4:
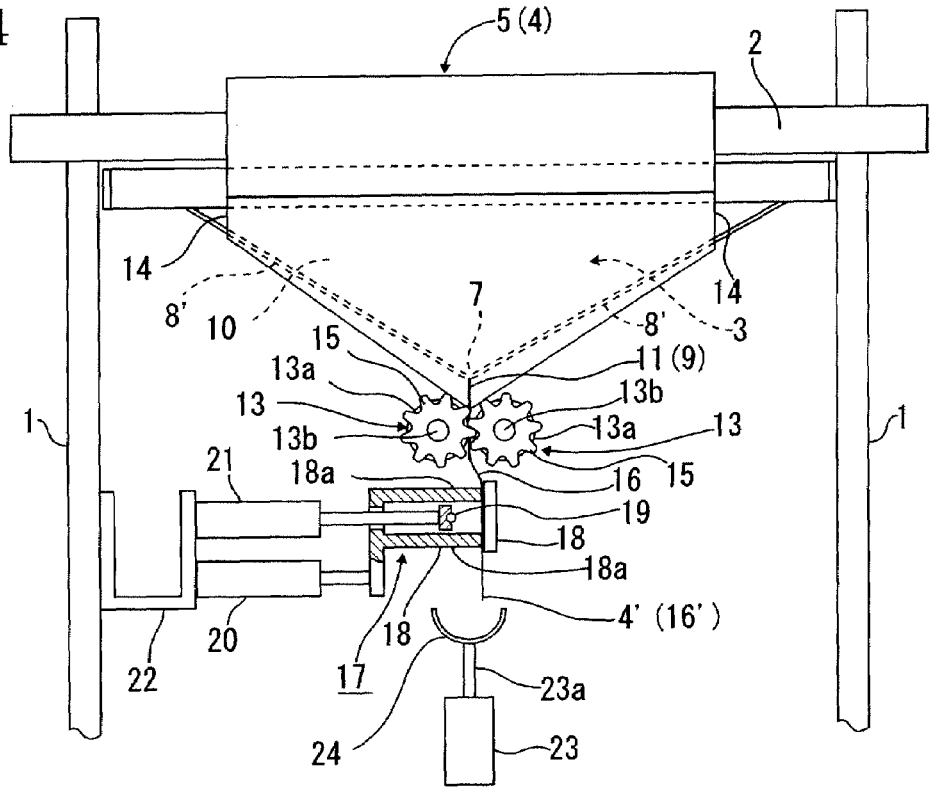
FIG. 4 is a view for showing how the overlapped portion of FIG. 3 is held by a pair of support plate.

As shown in FIG. 4, an end portion 16' of the overlapped portion 16, which is pulled out and formed by the pair of drawing rolls 13 and 13 using the fusing and cutting device 17 driven by the cylinder device 20, is held in the overlapping direction by the pair of supporting plates 18 and 18. Next, as shown in FIG. 5, driving a cylinder device 21 brings the heating wire 19 closer to the other supporting plate 18, thereby fusing and cutting the overlapped portion 16 in the width direction to cut off the end portion 4' of the sheet 4.

Figure 7:
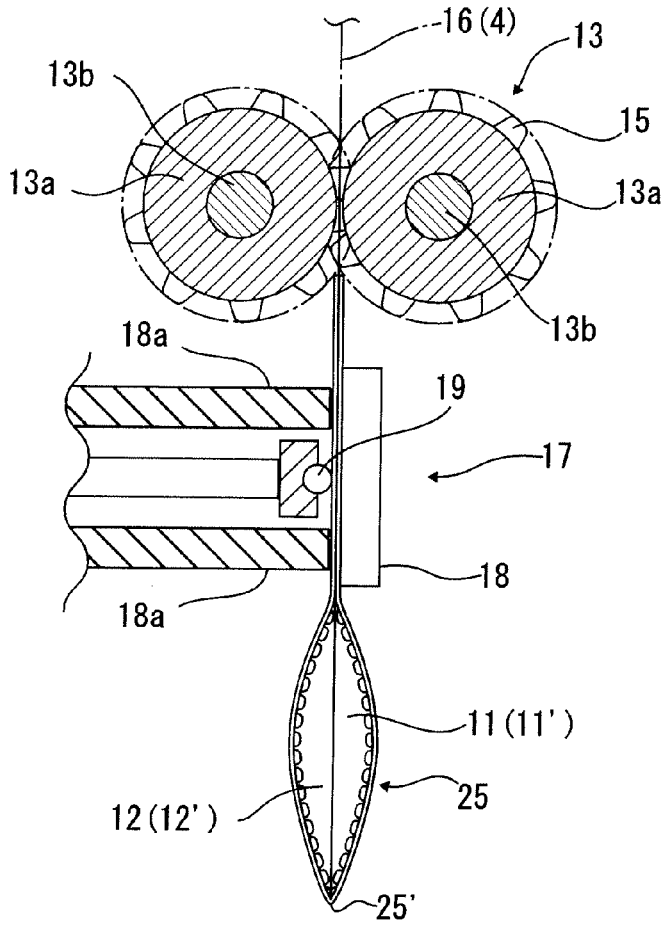
FIG. 7 is a front view of an incomplete packing bag shown in FIG. 6 that is partially expanded.

Driving the pair of drawing rolls 13 and 13 by a controller (not shown) automatically draws out the sheet 4 by a predetermined quantity, which, as shown in FIGS. 6 and 7, forms an incomplete packing bag 25 having the bending portion 11 as a bottom 11' and the aperture space 12 as an insertion aperture 12' of the packed material. In FIG. 7, a reference numeral 25' indicates a fused and cut portion that is formed in manufacturing an incomplete packing bag 25.

Figure 8:
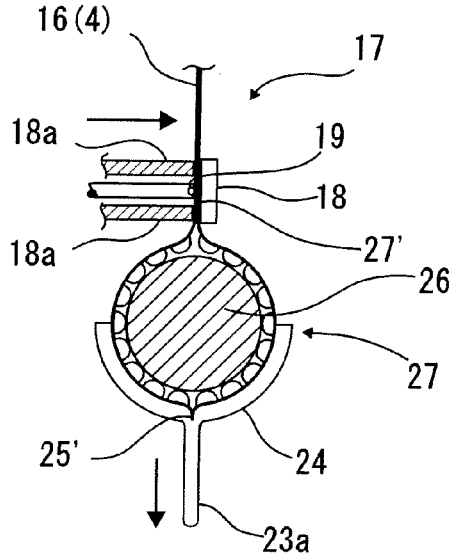
FIG. 8 is an illustrative view of how a packing bag is formed by inserting a packed member into the incomplete packing bag shown in FIG. 7.

As shown in FIG. 8, a fixing roll is inserted as an example of a packed material 26 from the insertion aperture 12' of the incomplete packing bag 25 into the inside of the incomplete packing bag 25. Next, the receiver 24 is raised. Using the fusing and cutting device 17, the incomplete packing bag 25, in which the packed material 26 is inserted, is fused and cut in the width direction to form a packing bag 27 in which the packed material 26 is inserted. When the packing bag 27 is formed, it is separated from the sheet 4. In FIG. 8, a reference numeral 27' represents a fused and cut portion that is formed in manufacturing the packing bag 27.

The cylinder device 23 is driven to lower the receiver 24, and the packing bag 27, in which the packed material 26 is inserted, is removed from the receiver 24. Consecutive repetition of a series of work from forming an incomplete packing bag to forming a packing bag enables the packing bag 27 to intermittently pack the packed material 26.

Figure 9:
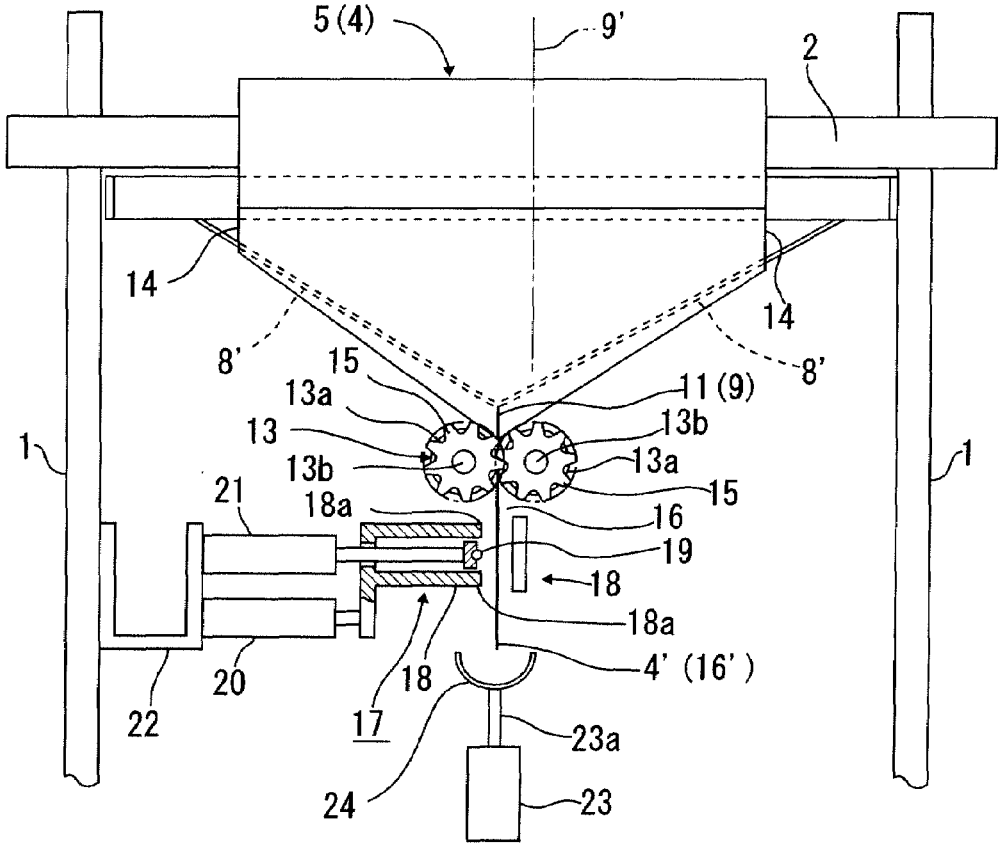
FIG. 9 is an illustrative view of how a packing bag having a spare region shown in FIG. 10 is formed.
Figure 10:
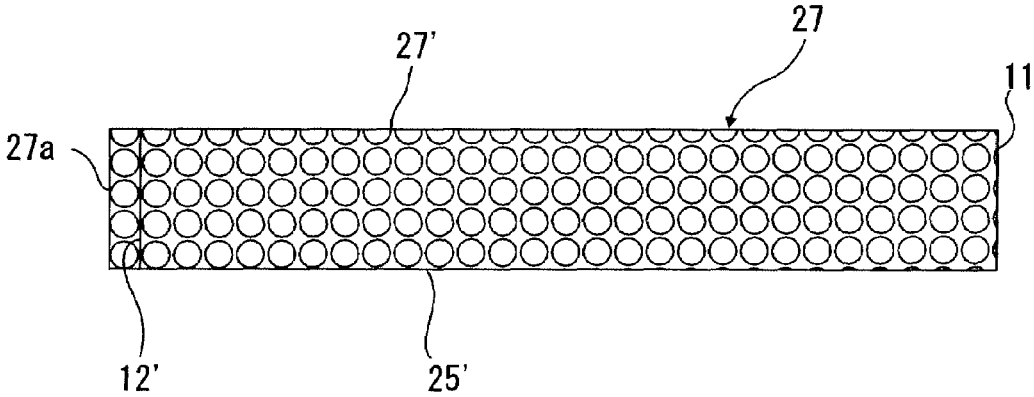
FIG. 10 is a front view of a packing bag having a spare region.

As shown in FIG. 9, when a width-direction center position 9' of the sheet 4 is shifted with respect to the vertex 7 by adjusting a spacer member (not shown) and the width-direction middle portion 9 of the sheet 4 is bent, a packing bag 27 having a spare region 27*a* in the insertion aperture 12' can be manufactured, as shown in FIG. 10.

The reason why the packing apparatus in accordance with the present invention does not cause a wrinkle will be described hereinbelow.

Figure 11A:
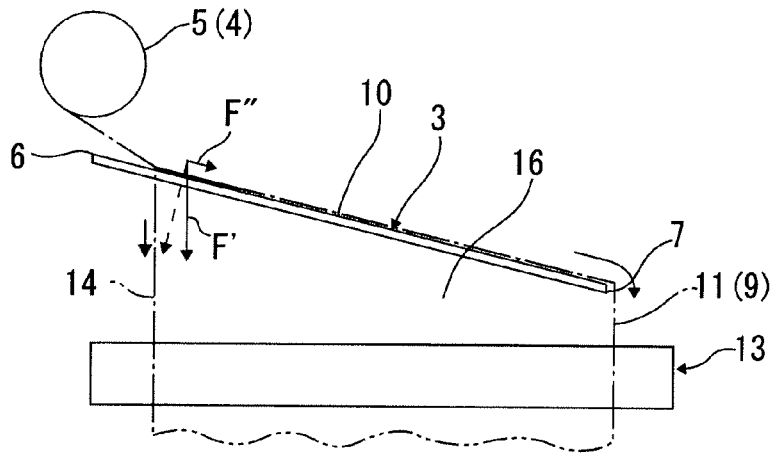
FIG. 11A is an illustrative view in which a triangular plate is placed inclined with respect to the horizon, with a pair of drawing rolls put horizontal.

FIG. 11A is an illustrative view in which a triangular plate is placed inclined with respect to the horizon, with a pair of drawing rolls put horizontal. As shown in FIG. 11A, when a pair of drawing rolls 13 and 13 is placed horizontally and the sheet 4 is pulled out, a component F" of a force F', which, designated by an arrow, exerts the width-direction sides 14 and 14 of the sheet 4, draws out the width-direction middle portion 9. The total drawn amount of the width-direction middle portion 9 is a sum of the drawn amount derived by the pair of drawing rolls 13 and 13 and the drawn amount obtained by pulling out the width-direction sides 14 and 14. Pulling out the sheet 4 by using the pair of rolls 13 and 13 draws out the width-direction middle portion 9 more than the width-direction sides 14 and 14.

That is, because pulling out the width-direction sides 14 and 14 acts the component F" orienting from the bottom 6 to the vertex 7, the width-direction middle portion 9 is drawn out by pulling out only the width-direction sides 14 and 14. Since the portions of the sheet 4 between the width-direction middle portion 9 and the width-direction sides 14 and 14 approach to the side of the vertex 7 as the sheet 4 is pulled out, the portions of the sheet 4 concentrates to the side of the vertex 7.

As a result of this, successive repetition of forming a packing bag 27 accumulates a difference in the drawn amount of the width-direction middle portion 9.

Figure 11B:
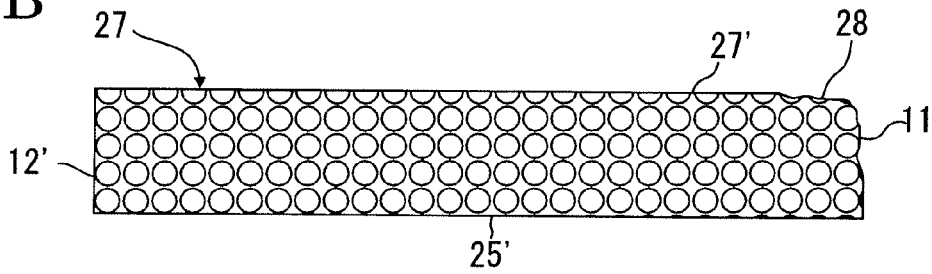
FIG. 11B shows a packing bag formed by the triangular plate and the pair of drawing rolls shown in FIG. 11A.

FIG. 11B shows a packing bag formed by the triangular plate and the pair of drawing rolls shown in FIG. 11A. As shown in FIG. 11B, the wrinkles 28 are produced in the bending portion 11, which forms a distorted packing bag 27.

Figure 11C:
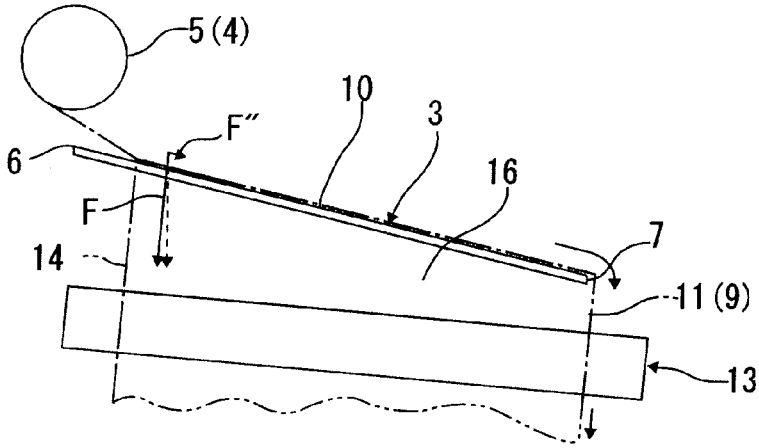
FIG. 11C is an illustrative view in which a triangular plate is placed inclined with respect to the horizon, with a pair of drawing rolls leaned having an inclined angle less than that of the triangular plate.

FIG. 11C is an illustrative view in which a triangular plate is placed inclined with respect to the horizon, with a pair of drawing rolls leaned having an inclined angle less than that of the triangular plate. As shown in FIG. 11C, when the pair of drawing rolls 13 and 13 is placed with an angle with respect to the horizon and the sheet 4 is pulled out, a force F, which resists a movement in the direction of pulling out the sheet 4, is applied on the width-direction sides 14 and 14 of the sheet 4. Sliding in the direction from the bottom 6 to the vertex 7, the sheet 4 is drawn out.

That is, when the pair of drawing rolls 13 and 13 is provided at a smaller angle than an inclined angle of the triangle plate 3, being obliquely with respect to the triangle plate 3 and the horizon, and in the same direction as the inclined direction of the triangle plate 3, the component F" orienting from the bottom 6 to the vertex 7 becomes smaller compared with the case in which the pair of drawing rolls 13 and 13 is provided horizontally.

Accordingly, when the width-direction sides 14 and 14 is pulled out using the pair of drawing roll 13 and 13, the drawn amount of the width-direction middle portion 9 becomes smaller compared with the case in which the pair of drawing roll 13 and 13 is provided horizontally as shown in FIG. 11A. And the drawn amount of the width-direction middle portion 9 becomes almost the same as that of the width-direction sides 14 and 14.

As a result of this, even if continuous formation of a packing bag 27 is repeated, the difference in the drawn amount of the width-direction middle portion 9 is not so accumulated as to produce a wrinkle.

Figure 11D:
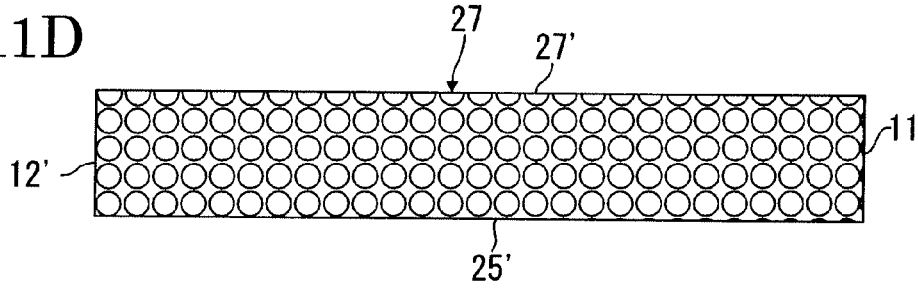
FIG. 11D shows a packing bag formed by the triangular plate and the pair of drawing rolls shown in FIG. 11C.

FIG. 11D shows a packing bag formed by the triangular plate and the pair of drawing rolls shown in FIG. 11C. As shown in FIG. 11D, a perfect packing bag 27 having no wrinkle in the bending portion 11 is formed.

Therefore, since the packing apparatus can prevent the generation of wrinkles without using a special member to eliminate the wrinkles, it can be miniaturized.

The embodiments of the present invention in which the packed material 26 is continuously packed are described hereinabove. However, only packing bags 27 can be continuously formed.

That is, the following procedure can be used to form a packing bag 27 consecutively. While the sheet drawn out from the original roll 5 is traveled along the triangular plane 10 of the triangular plate 3, a tension is applied to the sheet along the oblique side 8' that connects the base 6 and the vertex 7 of the triangular plate 3. In addition, while a reaction force F, which curbs the drawn quantity of the width-direction middle portion 9 of the sheet 4, is applied to the width-direction sides 14 and 14 of the sheet 4, the sheet 4 is slid toward the vertex 7 from the base 6, and is bent by the vertex 7. This forms a bending portion 11 on the side of the vertex 7 and a triangular open space 12 on the side of the base 6.

While the bending portion 11 is held by a pair of drawing rolls 13 and 13, the width-direction middle portion 9 of the sheet 4 is pulled out, and at the same time the mutually overlapped width-direction sides 14 and 14 are automatically drawn out. A overlapped portion 16, which is formed by pulling out the sheet owing to the pair of drawing rolls 13 and 13, is fused and cut out in a width direction, using the fusing and cutting device 17. This produces a packing bag 27, with the bending portion 11 as a bottom 11' and the open space 12 as an insertion aperture 12'.

The embodiments of the invention prevent wrinkles from being produced at a bending portion of a packing plastic bubble material sheet that is folded and piled up after being pulled out from an original roll. The embodiments can be small-sized.

The embodiments of the invention prevent wrinkles from being produced at a fusing portion, and can fuse and cut the folded and pile-up portion.

A series of processes from the manufacture of a packing bag to the packing of a packed member into a packing bag can be easily performed.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A method of forming a packing bag comprising:

traveling a packing plastic bubble material sheet pulled out from an original roll along a triangular plane of a triangular plate while applying a tension to the material sheet along oblique sides connecting a base and a vertex of the triangular plate;

sliding the material sheet from the base to the vertex while applying a reaction for curbing a drawn quantity of a middle portion of the material sheet in a width direction to both sides of the material sheet in a width direction that is contained in an overlapped portion;

forming a bending portion on a side of the vertex and a triangular open aperture on a side of the base by folding the material sheet using the vertex;

drawing out the width-direction middle portion and the overlapped width-direction sides while holding the bending portion through a pair of drawing rolls; and fusing and cutting the overlapped portion in a width direction using a fusing and cutting device to consecutively form a packing bag having the bending portion as a bottom and the open space as an insertion aperture for a packed member.

2. The method of forming a packing bag as recited in claim 1, further comprising:

placing the triangular plate in a position inclined downward from the base to the vertex with respect to a horizontal plane; and disposing the pair of drawing rolls to extend from the base to the vertex of the triangular plate and to be inclined with respect to the horizontal plane.

3. A method of forming a packing bag comprising:

traveling a packing plastic bubble material sheet pulled out from an original roll along a triangular plane of a triangular plate while applying a tension to the material sheet along oblique sides connecting a base and a vertex of the triangular plate;

sliding the material sheet from the base to the vertex while applying a reaction for curbing a drawn quantity of a middle portion of the material sheet in a width direction to both sides of the material sheet in a width direction that is contained in an overlapped portion having an end;

forming a bending portion on a side of the vertex and a triangular open aperture on a side of the base by folding the material sheet using the vertex;

drawing out the width-direction middle portion and the overlapped width-direction sides while holding the bending portion through a pair of drawing rolls;

fusing and cutting off the end of the overlapped portion in a width direction, using a welding and cutting device;

automatically pulling out a predetermined amount of the material sheet using the drawing rolls to form an incomplete packing bag having the bending portion as a bottom and the open space as an insertion aperture for a packed member;

inserting into the incomplete packing bag the packed member through the insertion aperture thereof;

fusing and cutting, in a width direction, the incomplete packing bag into which the packed member is inserted, using the welding and cutting device to form a packing bag with the packed member inserted therein; and consecutively iterating a series of steps from the step of forming an incomplete packing bag to the step of forming a packing bag.

4. The method of forming a packing bag as recited in claim 3, further comprising:

placing the triangular plate in a position inclined downward from the base to the vertex with respect to a horizontal plane; and disposing the pair of drawing rolls to extend from the base to the vertex of the triangular plate and to be inclined with respect to the horizontal plane.

5. A packing apparatus comprising:

a holding roll for holding an original roll having a packing plastic bubble material sheet that contains a middle portion in a width direction;

a triangular plate having a triangular plane, a base, a vertex, and oblique sides connecting the base and the vertex, the material sheet pulled out from the original roll, and folded in two at the width-direction middle portion by the vertex while being traveled along the triangular plane from the base to the vertex with a tension applied to the material sheet along the oblique sides, to form a bending portion on a side of the vertex, an overlapped portion containing sides in a width direction, and a triangular open space on a side of the base, the triangular plate being inclined downward from the base to the vertex with respect to a horizontal plane;

a pair of drawing rolls for drawing out the width-direction middle portion of the material sheet and the overlapped width-direction sides while holding the bending portion; and a fusing and cutting device positioned away from the drawing rolls for fusing and cutting the overlapped portion in a width direction to consecutively form a packing bag having the bending portion as a bottom and the open space as an insertion aperture for a packed member, wherein the drawing rolls are positioned with respect to the triangular plate so that the tension is produced in a direction to curb the bending portion that is supposed to be drawn out; and wherein the pair of drawing rolls extend from the base to the vertex of the triangular plate and are inclined with respect to the horizontal plane.

6. A packing apparatus as recited in claim 5, wherein the rolls are inclined downward at an angle that is smaller than an angle at which the triangular plate is inclined downward.

7. A packing apparatus comprising:

a holding roll for holding a original roll having a packing plastic bubble material sheet that contains a middle portion in a width direction;

a triangular plate having a triangular plane, a base, a vertex, and oblique sides connecting the base and the vertex, the material sheet pulled out from the original roll, and folded in two at the width-direction middle portion by the vertex while being traveled along the triangular plane from the base to the vertex with a tension applied along the oblique sides, to form a bending portion on a side of the vertex, an overlapped portion containing sides in a width direction, and a triangular open space on a side of the base;

a pair of drawing rolls for drawing out the width-direction middle portion of the material sheet and the overlapped width-direction sides while holding the bending portion; and a fusing and cutting device positioned away from the drawing rolls for fusing and cutting the overlapped portion in a width direction to consecutively form a packing bag having the bending portion as a bottom and the open space as an insertion aperture for a packed member, wherein the triangular plate is positioned having a downward inclination angle with respect to a horizontal plane from the base toward the vertex, wherein the drawing rolls are positioned having an inclination angle with respect to the horizontal plane so that the tension is produced in a direction to curb the bending portion that is supposed to be drawn out, and wherein the pair of drawing rolls extend from the base to the vertex of the triangular plate and are inclined with respect to the horizontal plane.

8. A packing apparatus as recited in claim 7, wherein the downward inclination angle for the rolls is smaller than the inclination angle for the triangular plate.

9. A packing apparatus as recited in claim 8, wherein the drawing rolls are synchronously rotated with respect to each other.

10. A packing apparatus as recited in claim 9, wherein the fusing and cutting device includes a pair of supporting plates for supporting the material sheet from an overlapping direction and a heating wire for fusing and cutting the overlapped portion, and wherein one of the supporting plates, positioned vertically, contains supporting portions positioned vertically with the heating wire placed therebetween for supporting the overlapped portion in cooperation with the other plate.

11. A packing apparatus as recited in claim 10, further comprising a receiver movable upward and downward for receiving a packed member inserted into the packing bag at the insertion aperture.

* * * * *